US005717995A

United States Patent [19]

Murai

[11] Patent Number: 5,717,995

[45] Date of Patent: Feb. 17, 1998

[54] BASEBALL GLOVE WITH FINGER PROTECTING STRIP

[75] Inventor: Hideaki Murai, Osaka, Japan

[73] Assignee: K S K Co., Ltd., Kagoshima, Japan

[21] Appl. No.: 760,364

[22] Filed: Dec. 4, 1996

[51] Int. Cl.[6] ..... A41D 13/08

[52] U.S. Cl. ..... 2/19

[58] Field of Search ..... 2/16, 19, 18, 20, 2/158, 159, 160, 161.1, 161.5, 161.6, 163, 162, 164

[56] References Cited

U.S. PATENT DOCUMENTS

| | | | |
|---|---|---|---|
| 2,778,023 | 1/1957 | Tompkins | 2/19 |
| 3,602,915 | 9/1971 | Collins | 2/19 |
| 4,937,882 | 7/1990 | Hayes | 2/19 |
| 5,031,239 | 7/1991 | Panichello et al. | 2/19 |
| 5,457,819 | 10/1995 | Aoki | 2/19 |
| 5,575,005 | 11/1996 | Walker et al. | 2/19 |

*Primary Examiner*—G. D. Crowder
*Assistant Examiner*—Larry D. Worrell, Jr
*Attorney, Agent, or Firm*—Armstrong, Westerman, Hattori, McLeland & Naughton

[57] ABSTRACT

A baseball glove is provided wherein the index finger of the wearer of the baseball glove is protected from being damaged by the opening edge of the glove even in the event that the glove is used with the index finger of the wearer of the glove projecting outside of the backside of the glove. The baseball glove includes a finger protecting strip in the glove body for contacting an inner surface of a proximal end portion of a finger which projects outside from an opening portion formed in the backside of the glove body. The finger protecting strip is also for guidance into an inside of the glove body when the wearer of the glove is placing the glove on his/her hand.

2 Claims, 8 Drawing Sheets

(Fig. 1 )
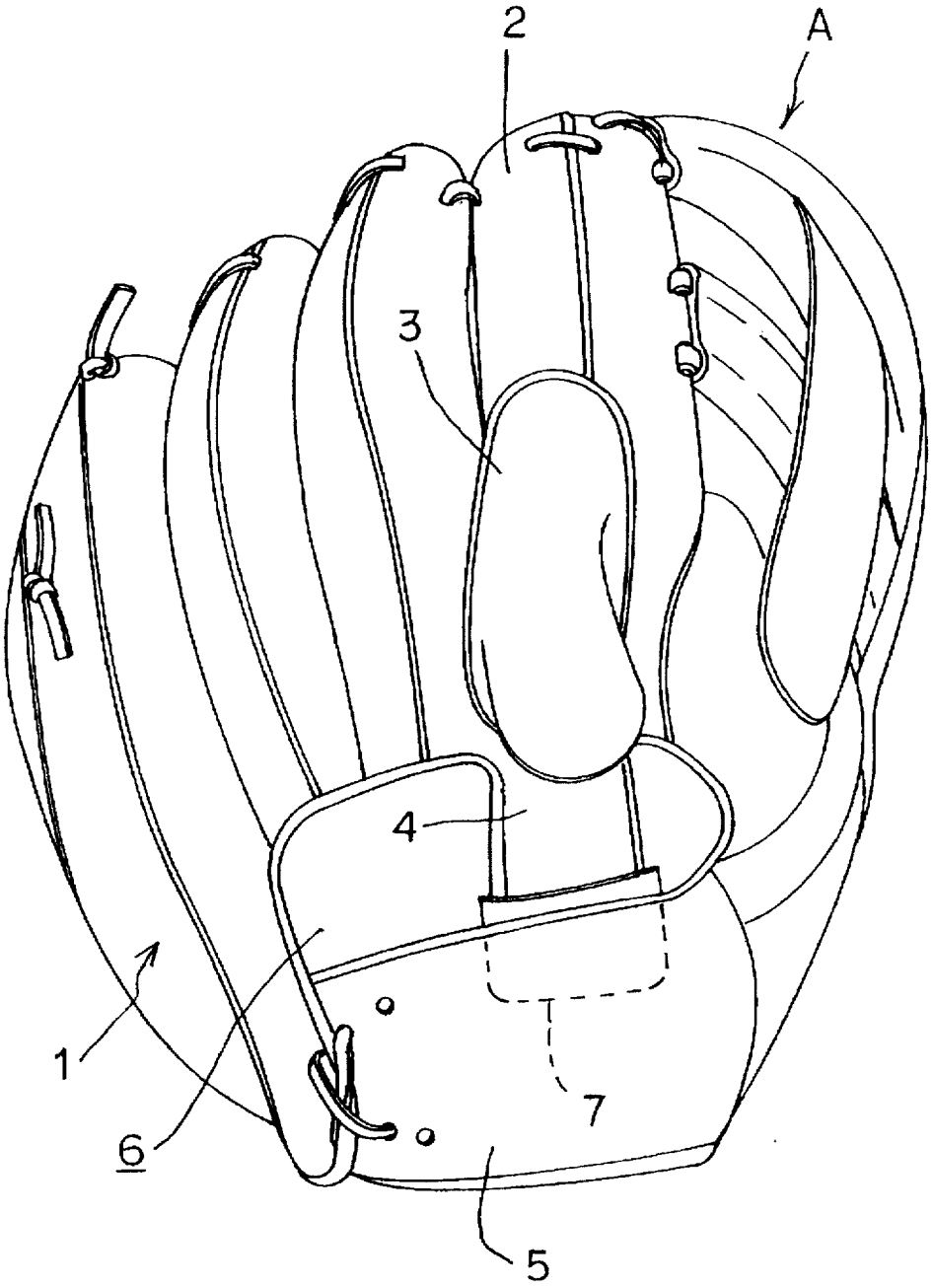

(Fig. 2 )
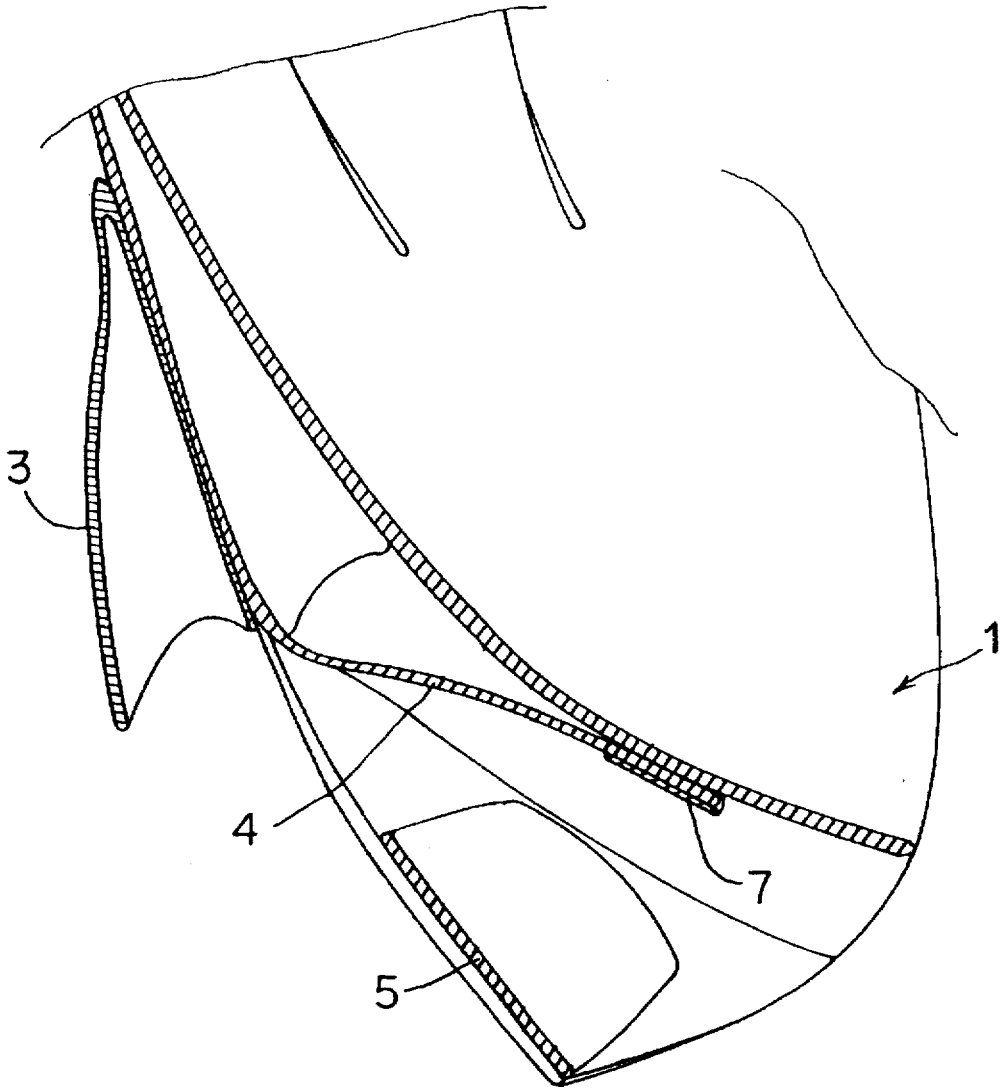

(Fig. 3 )
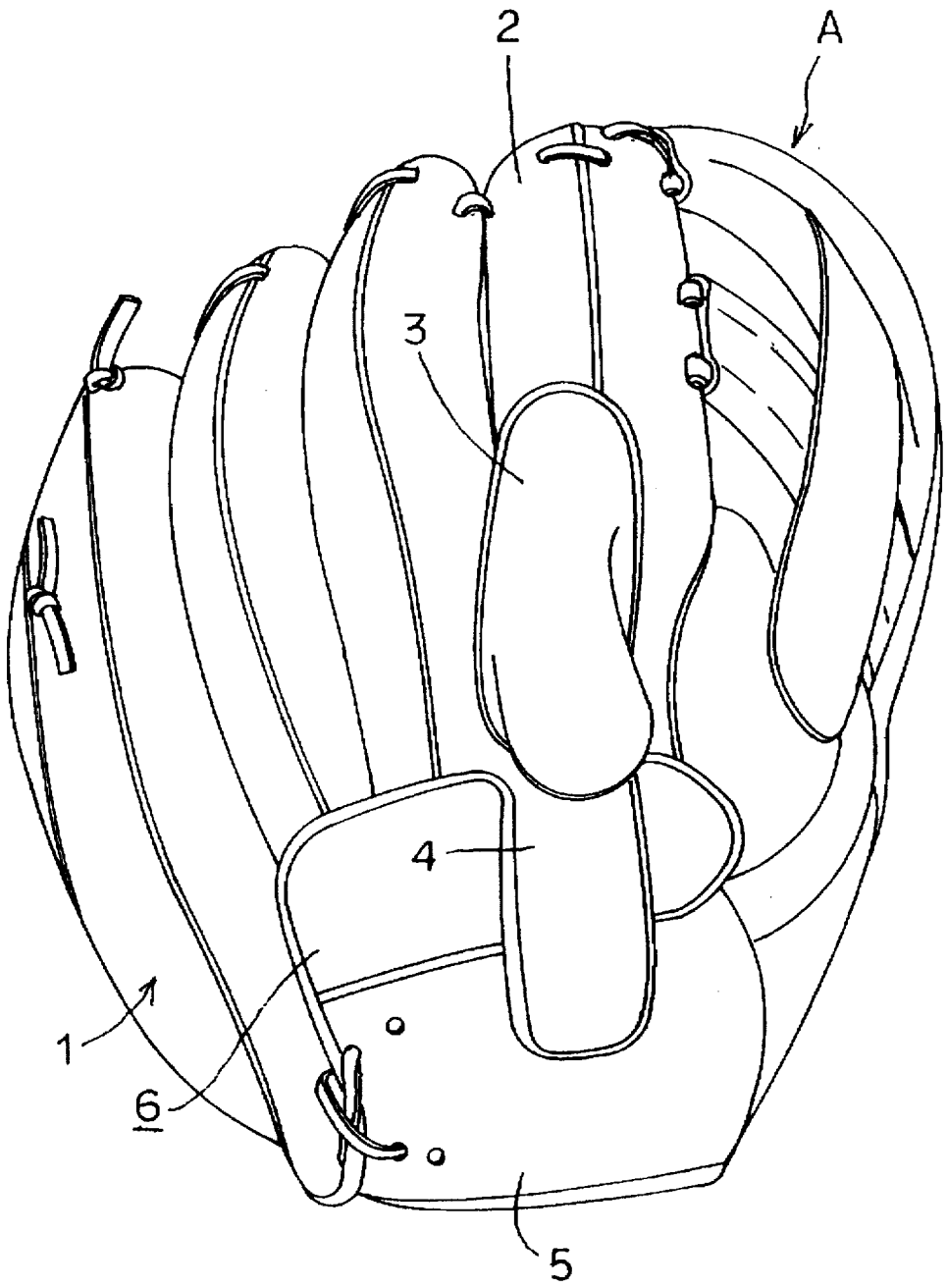

(Fig. 4 )
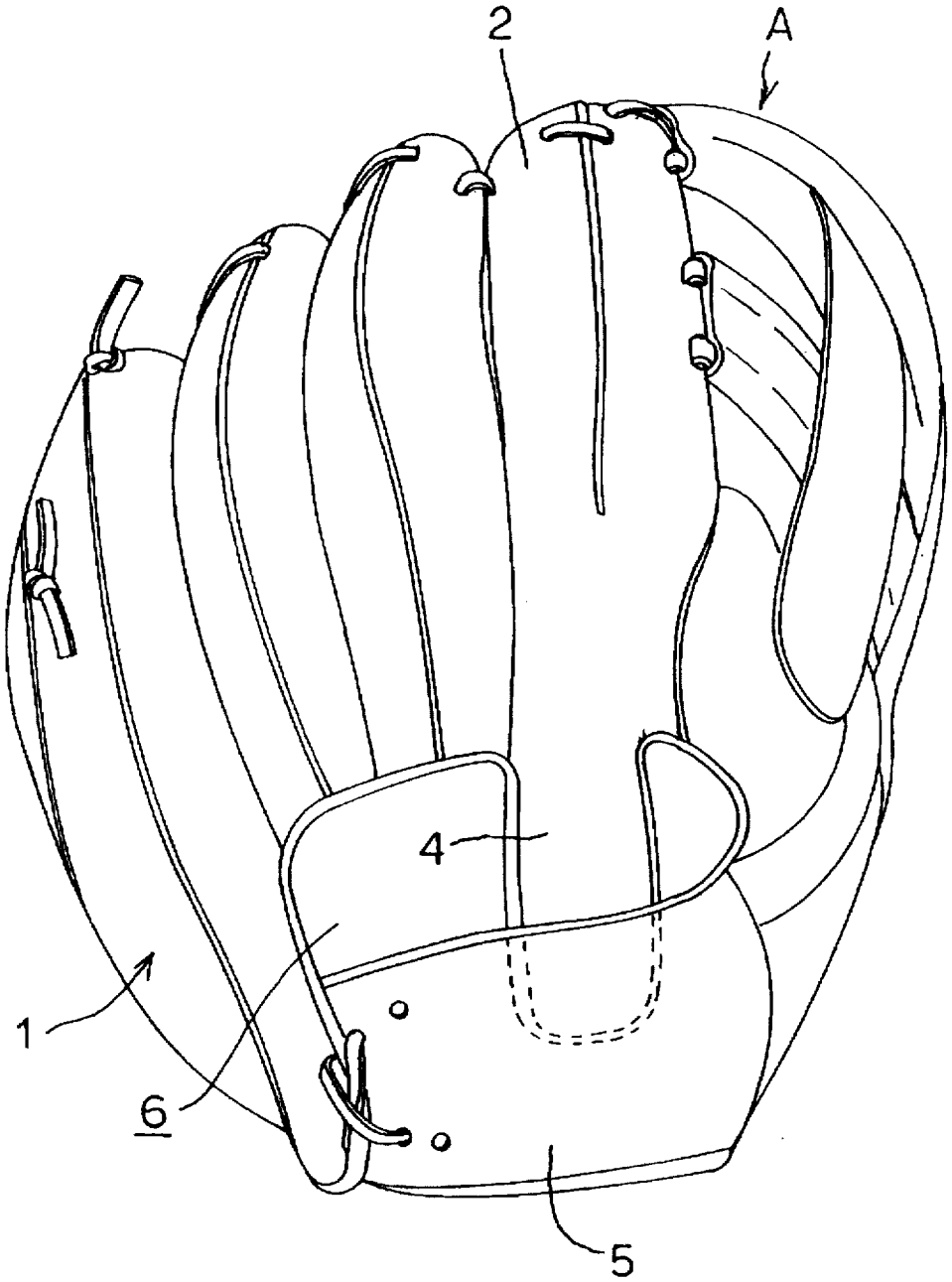

(Fig. 5 )
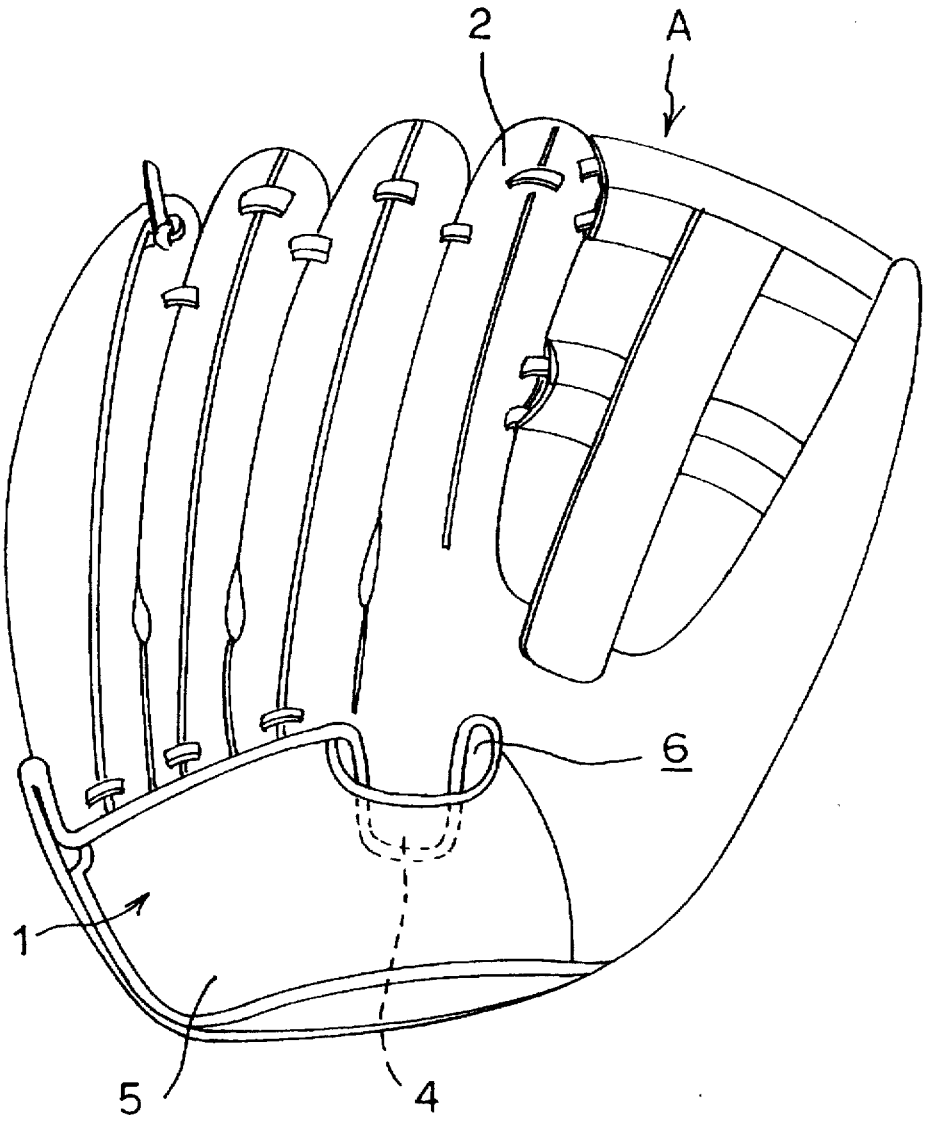

(Fig. 6 )
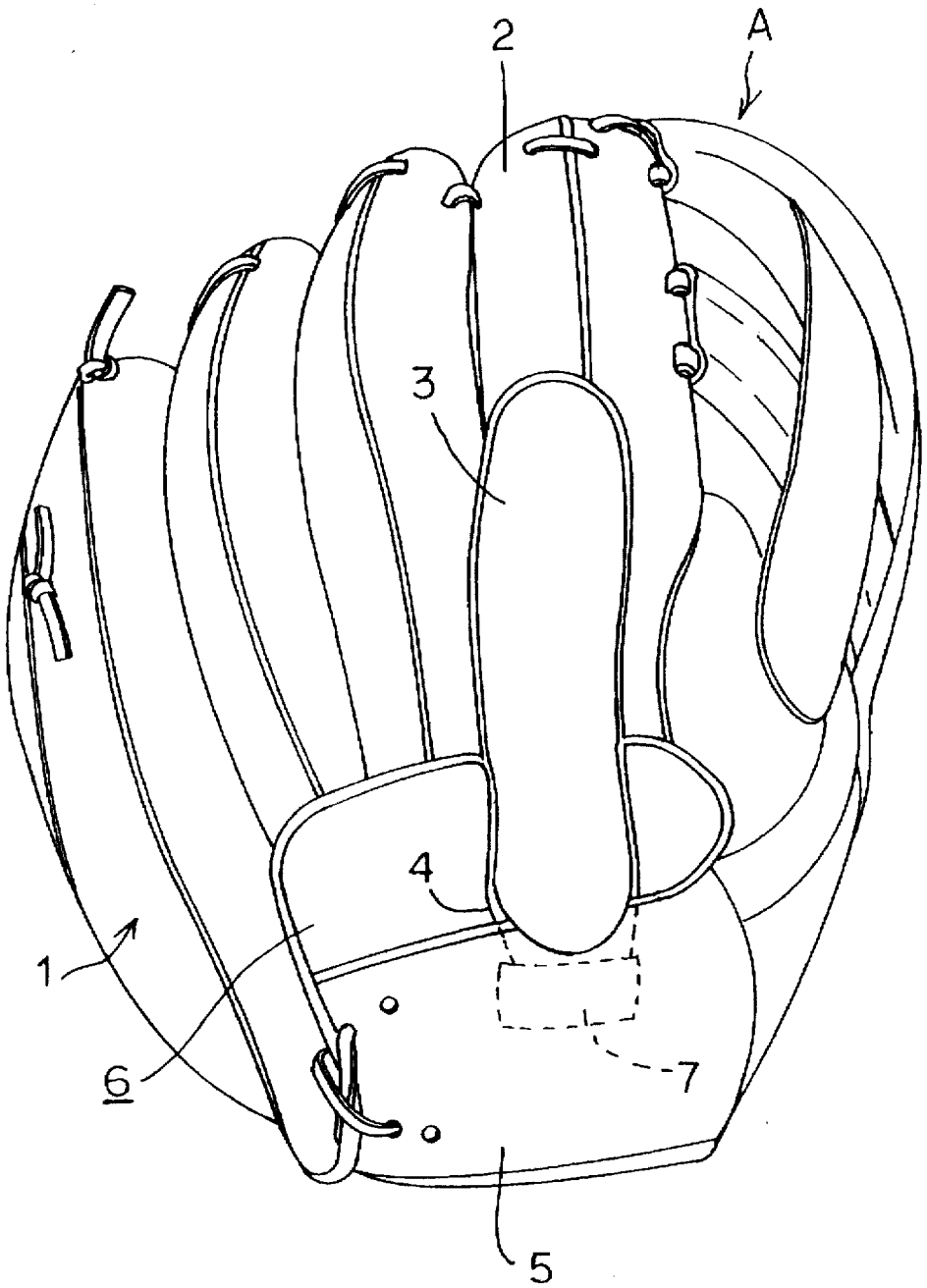

(Fig. 7 )
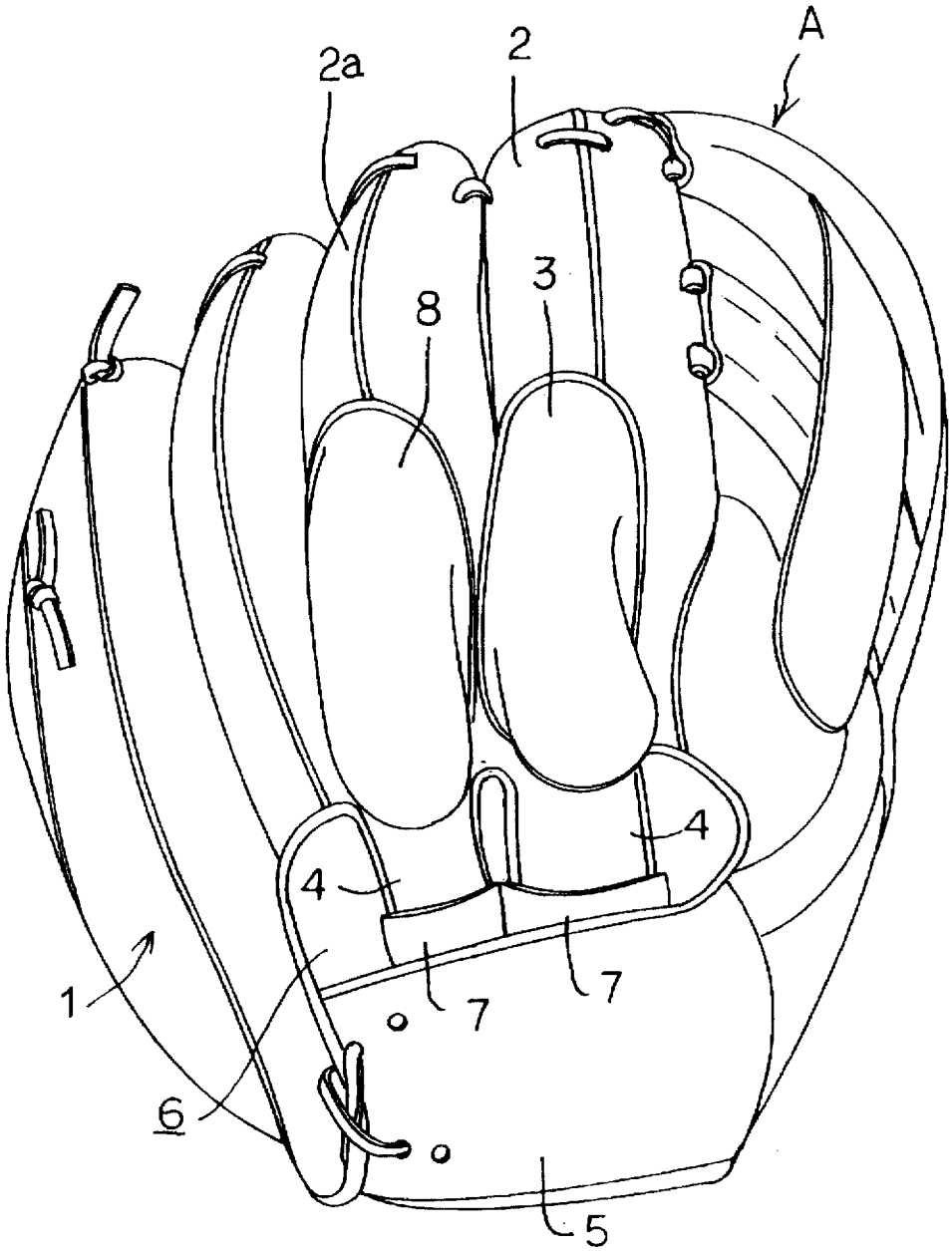

(Fig. 8 )
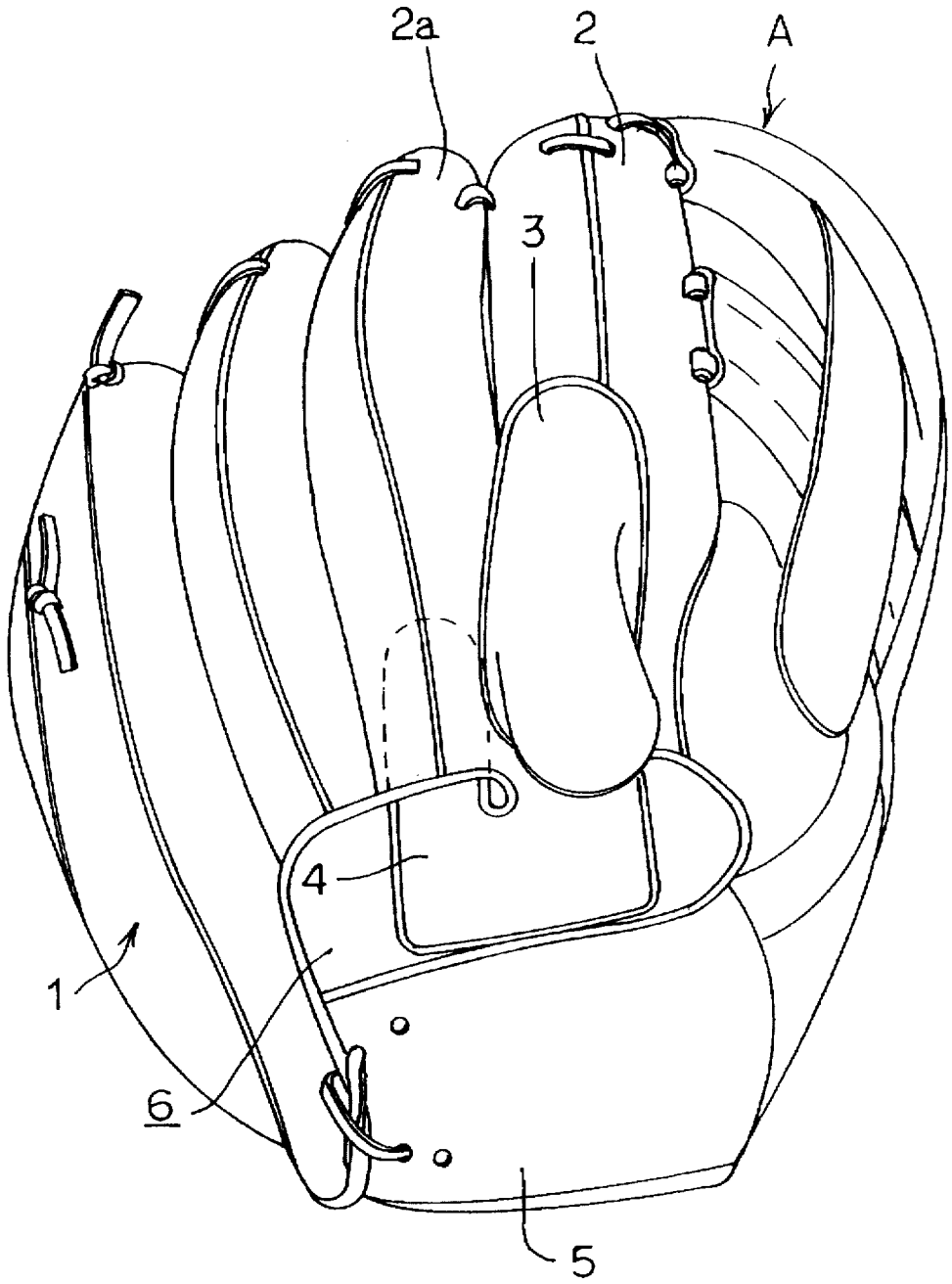

BASEBALL GLOVE WITH FINGER PROTECTING STRIP

BACKGROUND OF THE INVENTION

The present invention relates to a baseball glove in which a proximal portion of a player's index finger is protected from injury caused by an opening edge of the glove, for example, in the case where the glove is used with the index finger projecting outside through the opening, for easily catching the ball.

Recently, in order to easily catch a ball, a baseball player frequently uses his baseball glove with his index finger projecting outside of an opening portion above a belt portion of a backside surface of the glove and supporting the backside of a finger sack of the glove.

However, such a usage of the glove causes a problem that, when the glove is closed for catching the ball, the inner surface of the proximal portion of the index finger is brought into contact with the opening edge so that the index finger would be injured or damaged.

SUMMARY OF THE INVENTION

Accordingly, an object of the present invention is to provide a baseball glove which may be used under the condition that the index finger or similar is protected from being injured by the opening edge of the glove even in the case where, for example, the glove is used with the index finger projecting outside of the glove backside.

As a result of an intensive study for solving the above-described problem, the inventor has made the present invention of a baseball glove which is characterized in that a finger protecting strip is provided in a glove body for contacting an inner surface of a proximal end portion of a finger which projects outside from an opening portion formed on a backside of the glove body and for guidance into an inside of the glove body upon using the glove.

More particularly, it is preferable to use a glove in which an index finger retaining sack is provided in a backside of a finger sack of the glove so that an index finger, projecting outside through an opening portion upon using the glove, is inserted for locating the index finger in place. It is also preferable to provide a finger protecting strip extending from a proximal end of the index finger retaining sack to the opening portion of the glove.

It is more preferable that a fastening band be provided within the glove body so that a distal end portion of the finger protecting strip can be inserted into the fastening band for holding purposes.

BRIEF DESCRIPTION OF THE DRAWINGS

FIG. 1 is a perspective view showing a baseball glove in accordance with a first embodiment of the present invention;

FIG. 2 is an enlarged longitudinal sectional view showing a primary part of the first embodiment of the present invention;

FIG. 3 is a perspective view of a baseball glove according to the first embodiment of the present invention showing a state in which a finger protecting strip projects outside of the glove body of the baseball glove;

FIG. 4 is a perspective view showing a baseball glove according to a second embodiment;

FIG. 5 is a perspective view showing a baseball glove according to a third embodiment;

FIG. 6 is a perspective view showing a baseball glove according to a fourth embodiment;

FIG. 7 is a perspective view showing a baseball glove according to a fifth embodiment; and FIG. 8 is a perspective view showing a baseball glove according to a sixth embodiment.

DESCRIPTION OF THE PREFERRED EMBODIMENTS

The present invention will now be described with reference to the accompanying drawings embodying the present invention of a baseball glove.

FIGS. 1 to 3 show a baseball glove according to a first embodiment of the present invention. The baseball glove A is constructed so that an index finger retaining sack 3 for locating the index finger outside of the glove is provided on a backside of an index finger sack 2 of a glove body 1, and a finger protecting strip 4 is provided extending from a proximal end portion of the index finger protecting sack 3 into the glove. Since the finger protecting strip 4, shown in FIGS. 1 to 3, is provided integrally with the index finger sack 2 of the glove body 1, the finger protecting strip 4 is made of the same material as that of the glove body.

As shown in FIG. 1, an opening portion 6 is formed above a belt portion 5 of the glove backside of the glove body 1. The finger retaining sack 3, having an open proximal end, is stitched to the backside of the index finger sack 2 of the glove body 1. The finger protecting strip 4, for contacting and guiding the index finger, is provided so as to extend from the proximal end of the index finger retaining sack at the opening edge within the glove. Furthermore, a fastening band 7, for holding the finger protecting strip 4, into which a distal end of the finger protecting strip 4 is inserted, is provided in the glove. In the embodiment shown in FIGS. 1 to 3, the fastening belt 7 may hold the distal end portion of the finger protecting strip 4, inserted into the fastening belt 7, by stitching together both ends of the band member. Incidentally, in the baseball glove A shown in the FIGS. 1 to 3, the distal end portion of the index finger sack 2 is closed and only the proximal end portion thereof is opened. However, the present invention is not limited to this structure. The present invention may equally be applied to the case where both end portions are opened if the index finger may be supported in place.

Then, in the baseball glove A according to the first embodiment, the distal end portion of the finger protecting strip 4 is inserted from the opening portion 6 above the belt portion 5 of the glove backside, and the distal end of the finger protecting strip 4 is inserted into the fastening band 7 and held thereat. Thereafter, the baseball player's hand is inserted into the glove and at the same time his index finger is inserted into the glove A.

Also, in the case where the glove is not used with the index finger projecting outside, but is instead used in a normal manner, the finger protecting strip 4 is not located within the opening portion 6 of the glove. As shown in FIG. 3, in the case where the finger protecting strip 4 is located outside of the belt portion 5 or otherwise, the distal end of the finger protecting strip 4 is not inserted into and held at the fastening band 7. Thus, the finger protecting strip 4 is just located on the backside of the finger.

With the baseball glove according to the first embodiment of the present invention, the distal end portion of the finger protecting strip 4 is inserted from the opening portion 6 above the belt portion 5 of the glove backside, and the distal end of the finger protecting strip 4 is inserted into and held at the fastening band 7. Thereafter, the player's index finger is projected from the opening portion 6 above the belt portion 5 of the glove backside and is inserted into the index finger retaining sack 3 to contact the backside of the index finger sack 2. The proximal end portion of the index finger is brought into contact with the finger protecting strip 4 and is well protected as it is being guided thereto. Accordingly, although the index finger projects outside of the opening portion 6 of the backside of the glove body 1 for positively catching the ball, the proximal end portion of the index finger is not injured or damaged by the opening edge of the glove body 1. The glove may be used while the index finger is well protected. In addition, the finger protecting strip 4 is made of the same material as the glove body. 1 and the preferred material is leather. This is gentle for the finger. If the glove is used for a long time, the material of the finger protecting strip 4 may conform to the shape of the user's finger to better fit the finger.

Incidentally, in the example described above, both the finger protecting strip 4 and the finger retaining sack 3 are provided on the backside of the glove. However, it is possible to modify this structure as follows. As shown in FIG. 4 which illustrates a baseball glove A according to a second embodiment of the present invention, the index finger retaining sack 3 is not provided, but only the finger protecting strip 4 is provided. In this case, it is possible to enjoy the function of protecting the inner surface of the proximal end of the index finger.

Referring to FIG. 4, the baseball glove A is related to a glove having the belt portion 5 and the opening portion 6 on the backside of the glove body 1. However, as shown in FIG. 5 relating to a baseball glove A according to a third embodiment, the present invention may be applied to the case where the proximal end portion of the index finger sack 2 is cut away so that only the opening portion 6 is formed. The finger protecting strip 4 may be provided in such a glove.

FIG. 5 shows a baseball glove in accordance with a fourth embodiment of the present invention. As shown in FIG. 6, the baseball glove A is constructed so that the proximal end portion of the index finger retaining sack 3 is elongated relative to the finger protecting strip 4 as compared with the baseball glove according to the first embodiment. In this case, the positional relationship is established so that the index finger retaining sack 3 may cover the entire index finger. This may be attained by providing the finger protection strip 4. Since it is possible to locate the entire index finger in the index finger retaining sack 3 by using the baseball glove A according to the fourth embodiment, there is no fear that the index finger may be injured, even when a user of the glove makes rough plays.

FIG. 7 is a view showing a baseball glove according to a fifth embodiment of the present invention. In the baseball glove A, as shown in FIG. 7, a pair of finger retaining sacks 3 and 8 and a pair of finger protecting strips 4 and 4 are provided. In the baseball glove according to the first embodiment, the single index finger retaining sack 3 and the single finger protecting strip 4 for locating and holding the index finger are provided, whereas in the baseball glove according to the fifth embodiment, the index finger retaining sack 3 and the middle finger retaining sack 8 for locating and holding the index finger and the middle finger are projected for the index finger sack 2 and the middle finger sack 2*a*, respectively, and the finger protecting strips 4 and 4 are provided from the proximal ends of the finger retaining sacks 3 and 8, respectively. Although not shown in particular, it is possible to selectively provide only the middle finger retaining sack, or only the ring finger retaining sack, or a plurality of retaining sacks as desired. Incidentally, in the above-described examples, the invention has been explained by exemplifying baseball gloves including a field glove and a first base mitt. It is possible to apply the index finger retaining sack 3 and a finger protecting strip 4 to a catcher's mitt in the same way.

FIG. 8 is a view showing a baseball glove in accordance with the sixth embodiment of the present invention. In the baseball glove A, as shown in FIG. 8, the finger protecting strip 4 is U-shaped and extends into the opening portion 6 similarly to the baseball glove according to the first embodiment. The protecting strip 4 may be inserted into and held at the middle finger sack 2*a* of the glove body 1. If, thus, the baseball glove according to the sixth embodiment is used with the index finger being inserted into the index finger retaining sack 3, the finger protecting strip 4 is widely contacted with the proximal end portions of the index finger and the middle finger. As a result, a shock upon catching the ball may be moderated. In addition, it is unnecessary to provide the fastening band 7 as compared with the baseball glove according to the first embodiment. It is therefore possible to simplify the structure and to produce the glove in low cost.

As is apparent from the foregoing description, the present invention has the following effects and advantages.

In the baseball glove according to a first aspect of the present invention, the distal end portion of the finger protecting strip is inserted from the opening portion above the belt portion of the glove backside and located inside. Thereafter, the player's hand is inserted into the glove, for example, with his index finger projecting outside of the opening portion of the glove and contacting the index finger sack. As a result, the proximal end portion of the index finger is protected while being contacted and guided by the finger protecting strip. Accordingly, although, for example, the index finger projects outside from the opening portion of the backside of the glove body for positively catching the ball, the proximal end portion of the index finger is not injured by the opening edge of the glove body while the index finger projects our of the glove body during play.

In the baseball glove according to a second aspect of the present invention, the player's hand is inserted into the glove and at the same time the index finger is inserted into the index finger retaining sack so that the proximal end portion of the index finger is brought into contact with and is well protected as it is being guided into the glove by the finger protecting strip. Accordingly, even if the user of the glove makes a rough play, the user's index finger would not be injured.

In the baseball glove according to a third aspect of the present invention, the distal end portion of the finger protecting strip is inserted from the opening portion above the belt portion of the glove backside, and the distal end of the finger protecting strip is inserted into and held at the fastening band. This prevents the finger protecting strip from being displaced during play.

Various details of the present invention may be changed without departing from its spirit or its scope. Furthermore, the foregoing description of the embodiments according to the present invention is provided for the purpose if illustration only, and not for the purpose of limiting the present invention as defined by the appended claims and their equivalents.

What is claimed is:

1. A baseball glove comprising:

a glove body having an outside, an inside, a frontside, a backside and an opening portion, wherein said opening portion is formed in said backside of said glove body;

a finger protecting strip provided in said glove body having an inner surface for contacting a proximal end portion of a finger of a wearer of said glove, and for guidance into said inside of said glove body upon said wearer wearing said glove; and a fastening band into which a distal end portion of said finger protecting strip is inserted for holding said finger protecting strip within said glove body.

2. A baseball glove, comprising:

a glove body having an inside, an outside, a frontside, a backside, an opening portion formed in a backside of said glove body, and an hand insertion opening leading to said inside of said glove body;

an index finger retaining sack having an index finger sack opening portion through a backside of said glove body, wherein when a wearer places a hand through said hand insertion opening and into said inside of said glove body, an index finger of said wearer of said glove projects through said index finger sack opening portion of said backside of said glove body to said outside of said glove body;

a finger protecting strip extending from a proximal end of said index finger retaining sack into said opening portion of of said backside of said glove body; and a fastening band, into which a distal end portion of said finger protecting strip is inserted for holding said finger protecting strip within said inside of said glove body.

* * * * *